US011174859B2

(12) United States Patent
Baum et al.

(10) Patent No.: US 11,174,859 B2
(45) Date of Patent: Nov. 16, 2021

(54) TURBOMACHINE WHICH CAN BE OPERATED BOTH AS HYDRAULIC MOTOR AND AS PUMP

(71) Applicant: Reginald Baum, Balingen-Endingen (DE)

(72) Inventors: Reginald Baum, Balingen-Endingen (DE); Robert Röß, Kvisvik (NO)

(73) Assignee: Reginald Baum, Balingen-Endlingen (DE)

( * ) Notice: Subject to any disclaimer, the term of this patent is extended or adjusted under 35 U.S.C. 154(b) by 437 days.

(21) Appl. No.: 15/028,192

(22) PCT Filed: Oct. 8, 2014

(86) PCT No.: PCT/DE2014/100352

§ 371 (c)(1),
(2) Date: Apr. 8, 2016

(87) PCT Pub. No.: WO2015/051784

PCT Pub. Date: Apr. 16, 2015

(65) Prior Publication Data

US 2016/0252083 A1 Sep. 1, 2016

(30) Foreign Application Priority Data

Oct. 8, 2013 (DE) ..... 10 2013 111 098.3

(51) Int. Cl.
*F04B 19/22* (2006.01)
*F04B 49/08* (2006.01)
(Continued)

(52) U.S. Cl.
CPC ..... *F04C 14/06* (2013.01); *F03C 2/08* (2013.01); *F04B 49/08* (2013.01); *F04C 2/10* (2013.01);
(Continued)

(58) Field of Classification Search
CPC .. F04B 1/06; F04B 1/063; F04B 1/066; F04B 1/2007; F04B 1/2021; F04B 1/2042;
(Continued)

(56) References Cited

U.S. PATENT DOCUMENTS 3,572,983 A * 3/1971 McDermott ..... F04C 2/104 418/131
3,799,201 A * 3/1974 Hansen ..... F01C 1/105 137/625.21

(Continued)

FOREIGN PATENT DOCUMENTS

DE 3015551 10/1981
DE 3029997 2/1982

(Continued)

OTHER PUBLICATIONS

International Search Report for PCT/DE2014/100352, English Translation attached to original, Both completed by the European Patent Office on Mar. 30, 2015 Altogether 7 Pages.

*Primary Examiner* — Dominick L Plakkoottam
*Assistant Examiner* — Charles W Nichols
(74) *Attorney, Agent, or Firm* — Smartpat PLC

(57) ABSTRACT

A turbomachine that can be operated as a motor and as a pump, having an axially fixedly mounted shaft, including a power section with rotating inlet and outlet and an associated controller. Because the axial forces (Fgx) have been made independent of the sense of rotation the turbomachine is significantly more reliable, and because the sealing forces have been adjusted it has significantly greater reliability (η) in both running directions. It can be operated with fluids and gases. The turbomachine can be extended by adding a control device and a drive for the control device so as to provide a freewheel function, a braking function and/or blocking function, and so as to shift, modify and optimize the characteristic curves across the entire control range. In
(Continued)

both the clockwise and anticlockwise directions the turbomachine has in principle the same properties, although these can be modified and optimized by the control device.

8 Claims, 6 Drawing Sheets

(51) Int. Cl.

| | |
|---|---|
| ***F04B 49/02*** | (2006.01) |
| ***F04B 53/10*** | (2006.01) |
| ***F04C 2/10*** | (2006.01) |
| ***F04C 14/06*** | (2006.01) |
| ***F04C 14/24*** | (2006.01) |
| ***F01C 1/10*** | (2006.01) |
| ***F01C 20/06*** | (2006.01) |
| ***F01C 20/24*** | (2006.01) |
| ***F03C 2/08*** | (2006.01) |
| ***F04C 14/04*** | (2006.01) |

(52) U.S. Cl.
CPC ..... *F04C 2/102* (2013.01); *F04C 14/04* (2013.01); *F04B 49/02* (2013.01)

(58) Field of Classification Search
CPC .. F04B 1/205; F04B 1/30; F04B 1/303; F04B 19/22; F04B 49/02; F04B 49/03; F04B 49/035; F04B 49/08; F04B 49/22; F04B 49/225; F04B 49/24; F04B 53/10; F01C 1/103; F01C 20/06; F01C 20/12; F01C 20/14; F01C 20/24; F03C 2/08; F04C 1/103; F04C 2/10; F04C 2/102; F04C 14/04; F04C 14/06; F04C 14/24
See application file for complete search history.

(56) References Cited

U.S. PATENT DOCUMENTS

| | | | | |
|---|---|---|---|---|
| 3,853,435 | A | 12/1974 | Ogasahara et al. | |
| 4,411,607 | A * | 10/1983 | Wusthof | F04C 2/105 418/61.3 |
| 4,435,130 | A * | 3/1984 | Ohrberg | F04C 14/265 417/310 |
| 4,635,605 | A | 1/1987 | Faupel et al. | |
| 4,992,034 | A * | 2/1991 | Uppal | F04C 2/104 137/625.23 |
| 7,832,996 | B2 | 11/2010 | Eisenmann | |
| 2008/0277239 | A1 * | 11/2008 | Gassmann | F04C 2/103 192/85.01 |

FOREIGN PATENT DOCUMENTS

| | | |
|---|---|---|
| DE | 19520405 | 12/1996 |
| DE | 102008025054 | 12/2009 |
| EP | 0166995 | 1/1986 |
| EP | 1074740 | 2/2001 |
| WO | 2006010471 | 2/2006 |

* cited by examiner

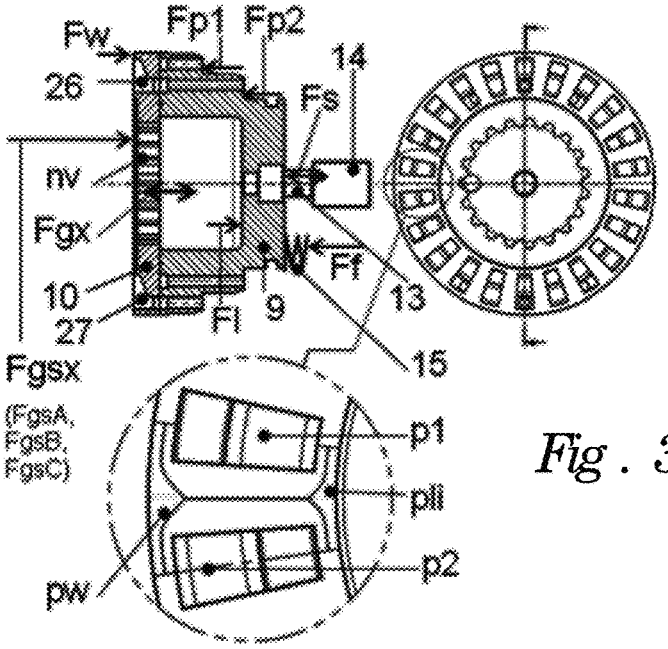
*Fig. 3*
*Fig. 4*
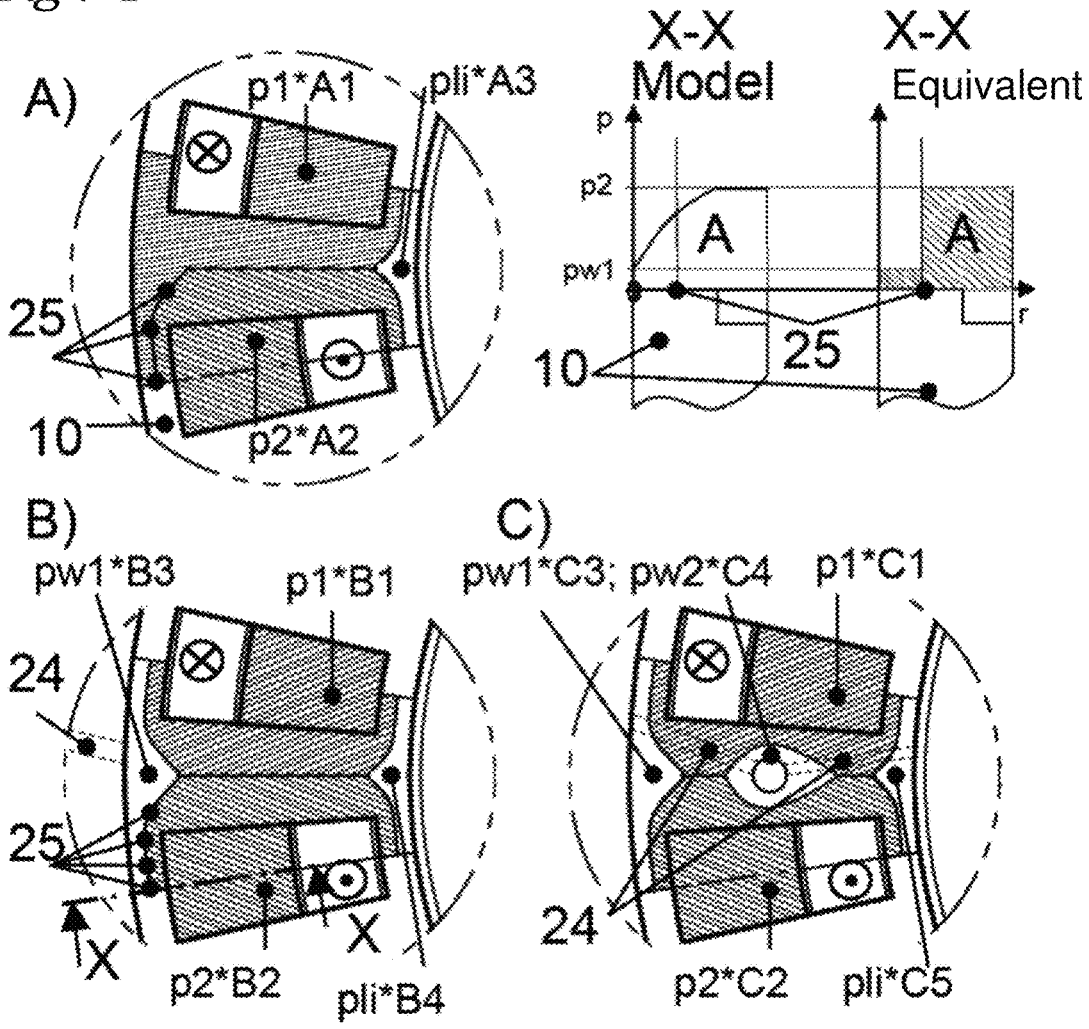

TURBOMACHINE WHICH CAN BE OPERATED BOTH AS HYDRAULIC MOTOR AND AS PUMP

CROSS-REFERENCE TO RELATED APPLICATION

This application is the U.S. national phase of PCT Application No. PCT/DE2014/100352 filed on Oct. 8, 2014, which claims priority to DE Patent Application No. 10 2013 111 098.3 filed on Oct. 8, 2013, the disclosures of which are incorporated in their entirety by reference herein.

TECHNICAL BACKGROUND

The present invention relates to a turbomachine which can be operated both as a hydraulic motor and as a pump, with a shaft which is mounted in an axially fixed fashion, comprising a power section and a controller which comprises at least one connecting part on which at least one distributor part with through-openings and at least one feed part, are arranged, wherein the distributor part is driven by means of at least one drive which is arranged on the shaft, and axial forces are distributed to a piston which is arranged axially on the distributor part, wherein the at least one inflow and outflow provided on the machine section is configured in a rotating fashion and is supplied by the distributor part and the piston, via the feed part, with at least two driving pressures which rotate concomitantly, wherein the driving pressures, with their annular faces, projected in association therewith, on the piston generate forces. In the text which follows, a power section is to be understood as being a machine which is supplied, for operation, with at least two feed pressures which rotate concomitantly, and for this purpose has an output which drives the distributor part of the turbomachine. The machine here may be either an adjustable or a non-adjustable machine.

PRIOR ART

A hydrostatic rotary piston engine with a non-variable volume flow is already known from the prior art in WO 2006/010471 A1. Furthermore, EP 0166995B1 describes a hydrostatic rotary piston machine with an infinitely variable volume. These machines can be operated either as a motor or as a pump and function with both right-hand rotation and left-hand rotation, and accordingly each have two operating modes as motor and pump in both senses of rotation and consequently four quadrants (motor with right-hand rotation, motor with left-hand rotation, pump with left-hand rotation and pump with right-hand rotation).

The disadvantage here is that very high pressure-dependent and rotational-direction-dependent axial forces occur in these machines. These forces give rise to very high pressure-dependent and rotational-direction-dependent friction losses. As a result, these machines are non-linear, have different properties during right-hand rotation and left-hand rotation and have reduced efficiency.

Further disadvantages of these solutions which are already known are described below. The unequal and non-linear behavior of the machines during right-hand rotation and left-hand rotation in both modes make them entirely unsuitable for many applications such as, for example, for use as wheel hub motor or, for example, for use as a measuring system or servo drive. A wheel hub motor, for example, must have precisely the same properties during right-hand rotation and left-hand rotation so that the left and right wheels are driven equally. The reduced efficiency also makes the machines unattractive for various applications and at the same time generates a lot of waste heat, which is even completely unacceptable in many applications. The unequal behavior during right-hand rotation and left-hand rotation is due to the design and can therefore be influenced only within quite narrow limits, by changing geometric parameters, during the configuration. Under certain pressure conditions it may even be found that such machines enter a state in which a very strong internal short-circuit flow arises and the function of the machine in one sense of rotation, and at least one operating mode, is even no longer provided; therefore, the entire function is not reliably ensured. In order to start up, the machines require very high pressure differences, which often prevents the possibility of use of such a drive. Moreover, machines of this design function only according to the three-tube principle with an inflow, outflow and separate leakage outflow. Further disadvantages of these machines are that they do not have a free-wheeling function, braking function or a soft start and also have no blocking function. In addition, the characteristic of the machines cannot be adapted to changed conditions during operation in all four quadrants. Furthermore, these machines are suitable only for operation with fluids owing to the large minimum pressure differences.

DE 10 2008 025 054 B4 discloses a hydraulic unit for making available a pressurized hydraulic fluid for driving a hydraulic actuator which is coupled thereto and which is equipped with a motor which is arranged in a pressurized motor housing, a hydraulic accumulator which is arranged in an accumulator housing, as well as a hydraulic pump arranged in a pump housing and a hydraulic block. It is characteristic of said hydraulic units that at least the motor housing, pump housing and the hydraulic block form a standardized rigid module which is easy to handle, and the hydraulic fluid flowing around in the module passes through all the elements of the module in the longitudinal direction (circulation system) in certain areas. The significant element of this hydraulic unit is that the hydraulic pump and the hydraulic block form one functional unit, the hydraulic block is provided with a multiplicity of hydraulic connection elements, and by means of a flange a delivery chamber which is arranged in the pump housing is covered by the hydraulic block on the side facing the motor housing.

U.S. Pat. No. 3,853,435 A discloses a hydraulic device comprising a housing with a fluid feed opening and a fluid discharge opening, wherein a rotor in the housing and the stator are provided, and in addition a rotor which is rotatable with respect to the stator, and has a low-pressure zone and a high-pressure zone. A commutator valve is rotatably accommodated in the housing, wherein in two cavities a high-pressure zone and a low-pressure zone are connected to the fluid feed connection and the fluid output opening.

SUMMARY OF THE INVENTION

The present invention is based on the object of providing a turbomachine in which the axial forces are, with the exception of a minimum force for sealing the running faces, very low or even zero, and which turbomachine can be used both as a pump and a drive machine and can be operated with all conceivable fluids, wherein it is intended to operate equally with right-hand rotation and left-hand rotation, and the function is intended to be reliably ensured independently of the pressure configurations of the driving pressures.

According to the invention, the above object is achieved with the features of claim 1. Advantageous refinements of the turbomachine according to the invention are specified in the dependent claims.

Accordingly, a turbomachine of the type mentioned is characterized in that at at least one end side of the distributor part, at least one further pressure acts on at least one equivalent area, and the efficiency using the entire resulting force which presses together the contact faces between the piston and the distributor, as well as between the distributor and the feed part, is changed within an adjustment range.

The turbomachine is preferably to be capable of being implemented using the two-tube principle without a separate leakage outflow, and can be equipped with a control device and an associated drive, with the result that it maintains its high efficiency even at high pressures. The control device is to make it possible to implement a freewheeling function, a braking function, a blocking function, a soft start, linearization of the characteristic curves and adaptation of characteristic curves to specific load requirements within an adjustment range.

All of the forces acting on the distributor part are firstly in equilibrium in each of the four operating states of the turbomachine, both in the axial and radial directions, with the exception of a sealing force. In order to be able to keep the axial forces in equilibrium even independently of the rotational speed and sense of rotation, additional pressure regions are arranged on the distributor part in such a way that a regular pressure distribution, which is symmetrical in itself, is formed on the end side of the distributor part. This equilibrium can then be changed selectively by means of an additional control device which is preferably provided and which has a drive. A control device is to be understood in the text which follows as a force-transmitting means which transmits axial forces to the piston. This force is generated by a separate drive and can also be used for braking or soft starting or blocking or decoupling the turbomachine.

It was quite surprising for a person skilled in the art that with the turbomachine according to the invention all the abovementioned disadvantages no longer occurred. The significant and decisive advantage of the proposed turbomachine is that it is very functionally reliable in all four quadrants, has the same properties with right-hand rotation and left-hand rotation and achieves a significantly higher efficiency and very high starting torques by eliminating friction losses.

BRIEF DESCRIPTION OF THE DRAWINGS

Further objectives, features, advantages and application possibilities of the turbomachine according to the invention can be found in the following description of an exemplary embodiment with reference to the drawings. Here, all the features which are described and/or illustrated figuratively form per se or in any desired combination the subject matter of the invention, independently of their combination in the individual claims or their back-reference.

In the drawings:

FIG. 3 shows the axial forces which act on the piston and the distributor part and are added together to form the total force;

FIG. 4 shows, in the first section X-X, the exemplary pressure profile with non-constant gradient between the driving pressure and the further pressure. In the second section, X-X, an alternative system with constant pressures and three instances of action of the total forces on the end side of the distributor part; the model and alternative system have the same area A below the curve;

IMPLEMENTATION OF THE INVENTION

Figure 1:
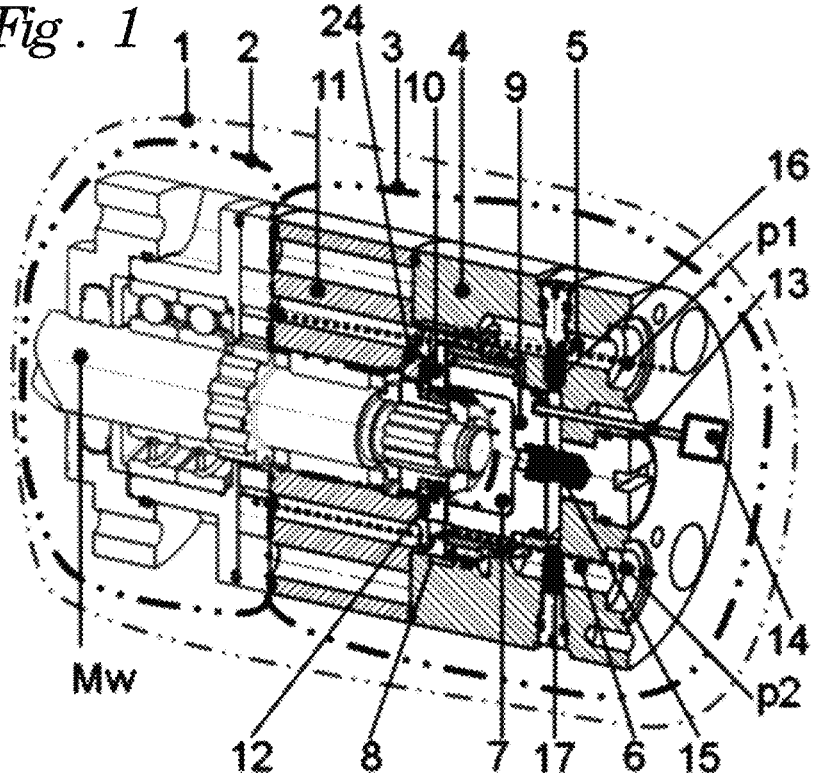
FIG. 1 shows an isometric sectional view through a turbomachine.

As is apparent from FIG. 1, the preferred turbomachine 1 is composed of a power section 2 and a controller 3, wherein the power section 2 drives the distributor part 10 via the drive 12. The power section 2 is supplied with rotating inflow and outflow with the two working pressures p1, p2 via the feed part 11. The distributor part 10 is arranged axially with respect to the feed part 11. The piston 9 is arranged axially on the distributor part 10 and is supplied axially with the two driving pressures p1, p2 via the connecting part 4. The piston 9, distributor part 10 and feed part 11 are arranged on the connection part 4. The two connections 5, 6 are in the connecting part 4.

The control device 13 acts on the piston 9 in the axial direction and is driven here by the drive of the control device 14. The two check valves 16, 17 are arranged between the inner leakage region 7 and the connections 5, 6.

A further pressure region 8, which is connected to the inner pressure region 7 via at least one feed line 24 in the feed part 11, is located at the outer edge of the distributor part 10.

A spring 15 generates a spring force Ff with which the piston 9 and the distributor part 10 are pressed onto the feed part 11, in order to seal these parts 10, 11 with respect to one another. Said spring 15 is arranged between the connection part 4 and the piston 9.

The axial and almost linear supply of the power section with the driving pressures p1, p2 is particularly advantageous here for the efficiency of the turbomachine 1. The flow of the fluid is hardly braked by deflections here.

In a further advantageous embodiment, the turbomachine 1 can also be embodied without a control device 13 with a drive of the control device 14. The advantage of this embodiment is that the turbomachine 1 becomes significantly more advantageous if none of the functions of free-wheeling, soft start, braking or blocking are required in the application, but merely an advantageous machine with excellent efficiency and the same functionally reliable behavior with right-hand rotation end left-hand rotation.

Figure 2:
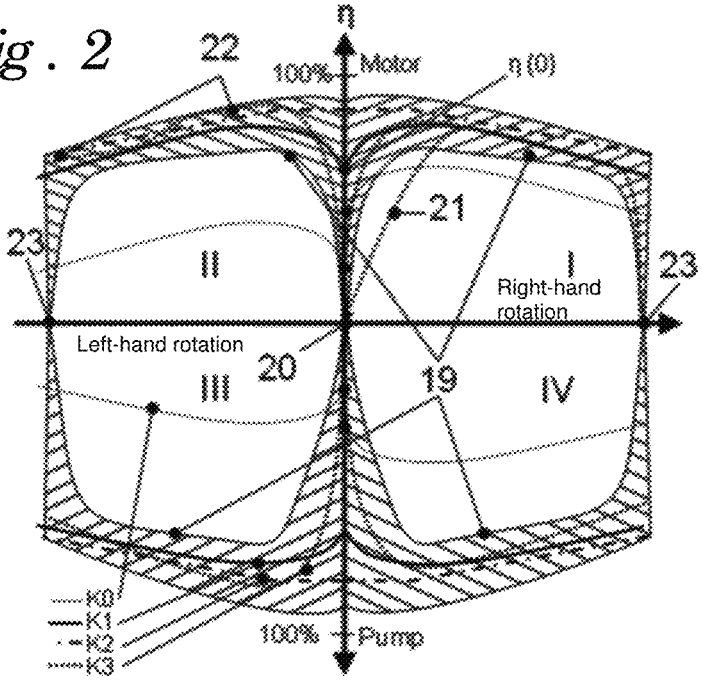
FIG. 2 shows a comparison between a typical characteristic curve of a drive which is already known and three possible characteristic curves within an adjustment range.

As is apparent from FIG. 2, conventional turbomachines have different characteristic curves K0 during right-hand rotation and left-hand rotation. In comparison to this, three possible characteristic curves K1, K2, K3 of the turbomachine 1 according to the invention within an adjustment range 19 are shown. The efficiency $\eta$ is shown against the rotational speed of the shaft nw. At constant driving pressures p1, p2, this is approximately proportional to the torque Mw nw.

The characteristic curve K1 shows by way of example the behavior of a turbomachine 1 without a control device 13. K1 is already virtually symmetrical or even completely symmetrical in the four quadrants I-IV. The relatively high starting torque at the shaft Mw in the first two quadrants I, II during driving, and the high starting torque in the two quadrants III, IV during pumping are advantageous here. The starting is always reliably ensured even when there are very small pressure differences between the two driving pressures p1, p2. A small starting torque is important, for example, in windmills, which as a result do not start to generate energy at, for example 3 m/s wind speed but instead already at, for example, 1 m/s wind speed.

The characteristic curve K2 shows, for example, a characteristic curve of a turbomachine 1 with a control device 13 and the drive of the control device 14, in which characteristic curve K2 the efficiency is linearized in certain sections and has been optimized for high pressures within the adjustment range 19 in that the necessary sealing forces in the turbomachine 1 have already been adapted to the respectively present pressure conditions of the two driving pressures p1, p2 and to the rotational speed of the turbomachine 1.

The characteristic curve K3 shows by way of example a turbomachine 1 which behaves differently in the four quadrants I-IV within the adjustment range 19. The blocking of the machine is illustrated at point 20. At said point, nw=0 and Mw=0. The braking 21 is illustrated, for example, in the first quadrant I on the characteristic curve K3. In the second quadrant II, the adaptation 22 of the characteristic curve K3 is shown by way of example. The free-wheeling 23 is illustrated with right-hand rotation and left-hand rotation. At said point Mw=0 and nw≠0.

A further advantage is that the turbomachine 1 according to the invention can now be controlled. In conjunction with its improved properties, its more reliable functioning and the additional functions of free-wheeling, soft start, braking and blocking, it is suitable for a multiplicity of applications such as, for example, as locomotion drives, windmills, measuring systems, drives in safety-protocol applications or servo drives.

As is apparent from FIG. 3, the axial forces acting on the piston 9 and the control plate 10 add together to form the total force Fg. The control plate 10 has here alternately through-openings 26, 27 through which the driving pressures p1, p2 can act. The driving pressure p1 generates here the force from p1 Fp1. The driving pressure p2 generates here the force from p2 Fp2. These forces Fp1, Fp2 are calculated from the driving pressures p1, p2 and the associated projected annular faces on the piston 9. The spring 15 generates the spring force Ff. The inner leakage pressure pli generates the force Fl with the associated projected face.

If the turbomachine 1 is equipped with a control device 13 having a drive 14, the control force Fs also acts additionally. On the inside of the distributor part 10, different pressures act, and they are also not distributed constantly. The force Fgsx is calculated therefore generally as Fgsx=∫pA, nv dA. Depending on the embodiment, Fgsx is calculated as FgsA, FgSB or FgsC. The precise pressure ratios on this face are non-linear, rotational-speed-dependent and very complex.

A segment with, in each case, a through-opening 26 of the driving pressure p1 and a through-opening 27 of the driving pressure p2 is illustrated in an enlarged form in FIG. 3, as well as, in each case, a pressure region of an inner leakage pressure p1 and of a further pressure pw1.

In order to illustrate these complex pressure ratios more clearly, virtually constant gradient between two pressures p1, p2, pli, pw1, pw2 . . . is assumed below. This results in simplified equivalent areas A1, A2, A3 . . . , B1, B2, B3 . . . , C1, C2, C3 . . . , with which the pressures are then multiplied and can be multiplied to form FgsA, FgsB and FgsC.

The sum of all these forces Fp1, Fp2, Fs, Ff, Fl, Fw, Fgsx is the total resulting force Fgx which, depending on the embodiment, is designated as FgA, FgB, FgC. The turbomachine 1 cannot start until this total resulting force Fgx presses together the contact faces between piston 9 and distributor plate 10 and between distributor part 10 and feed part 11 to a sufficient, but not excessive, degree, and therefore seals them, without blocking. Otherwise, either the inner short-circuit flow Vki of the outer short-circuit flow Vka comes about, since the piston 9, distributor part 10 and feed part 11 are not sealed with respect to one another, or the turbomachine 1 even blocks, since the contact pressure that generates the Fgx between the piston 9, distributor part 10 and feed part 11, is too high. It is therefore particularly advantageous always to be able to set the force Fgx to an optimum degree to the operating point of the machine by means of the control device 13 and the associated drive 14.

A further advantage is that when the control device 13 with the drive 14 is present it is even possible to dispense with the spring 15 if the spring force Ff is generated by the driven control device 13, 14.

Furthermore, a further advantage is that according to the case in which the piston 9 and/or the distributor 10 and/or the control device 13 are of magnetic design, axial forces can also be generated in this way. A simple electromagnet can then be used, for example, as a drive for the control device 13.

As is apparent from FIG. 4, the complex pressure distributions on the end sides of the distributor part 10 are illustrated in simplified form on an exemplary pressure profile with non-constant gradients between the driving pressure p2 and the further pressure pw1. In the second step X-X, a limiting point 25 is determined in such a way that the two areas A in the model system and in the equivalent system are equally large. If this procedure is carried out repeatedly at various locations on a turbomachine 1, the connection between the limiting points 25 gives rise to the equivalent areas A1, A2, A3, B1, B2, B3, B4, C1, C2, C3, C4, C5 . . . in which the respective pressure p1, pli, pw1, pw2 . . . is constant.

For the prior art, the action case A, where A1>>A2 is obtained. In the action case A, the total force FgsA is:
during left-hand rotation:

$$FgsA=p1*A1+p2*A2+pli*A3;$$

during right-hand rotation:

$$FgsA=p2*A1+p1*A2+pli*A3.$$

Both terms can only be equally large if A1=A2. However, this is precisely what never occurs here. Most of the serious disadvantages with conventional machines arise from this contradiction.

In action case B, a further pressure pw1 acts on the outside of the distributor part 10. The areas B1 and B2 are ideally equal in size. In the action case B, the total force FgsB on the end side of the distributor part 10 is:
During left-hand rotation:

$$FgsB=p1*B1+p2*B2+pw1*B3+pli*B4;$$

During right-hand rotation:

$$FgsB=p2*B1+p1*B2+pw1*B3+pli*B4.$$

Since the areas B1, B2 can be equal in size here, B1=B2. A total force at the end side FgB, and therefore also the force FgsB, are then equal in size irrespective of the sense of rotation.

It is advantageous that the turbomachine 1 now has gained the same or at least almost the same properties during right-hand rotation and left-hand rotation owing to the symmetrical conditions. A further advantage is that according to the case in which the further pressure pw1 is equal to the inner leakage pressure pi, the design of the turbomachine 1 is considerably simplified, since the pressure regions B3 and B4 now only have to be connected by feed lines 24.

In the action case C, the further pressure pw1 acts on the area C3 on the distributor part 10. The areas C1 and C2 are ideally equal in size. The area C4 is supplied with a further pressure pw2 via feed lines 24. This pressure may be, for example, the inner leakage pressure pli or else, as in the illustration, the further pressure pw1 which is present on the outside, or else also the control pressure pw2.

In the action case C, the total force FgsC at the end side of the distributor part 10 is therefore:
during left-hand rotation:

$$FgsC=p1*C1+p2*C2+pw1*C3+pw2*C4+pli*C5;$$

during right-hand rotation:

$$FgsC=p2*C1+p1*C2+pwl*C3+p2*C4+pli*C5.$$

Since the areas C1 and C2 can be equal in size here, C1=C2. The total force at the end side FgC and therefore also the total force FgsC can then be equal independently of the sense of rotation. If pli=pw1=pw2, the design of the turbomachine 1 is also in turn simplified considerably, since the pressure regions C3, C4, C5 only have to be connected by feed lines 24. This advantageously results in a multiplicity of conceivable configurations in order to optimize influence and optimize the properties of the turbomachine 1.

A further advantage is that a further pressure pw1 can also be fed in as a control pressure from the outside to the further pressure region 24 by means of at least one feed line, via the connecting part 4.

Figure 5:
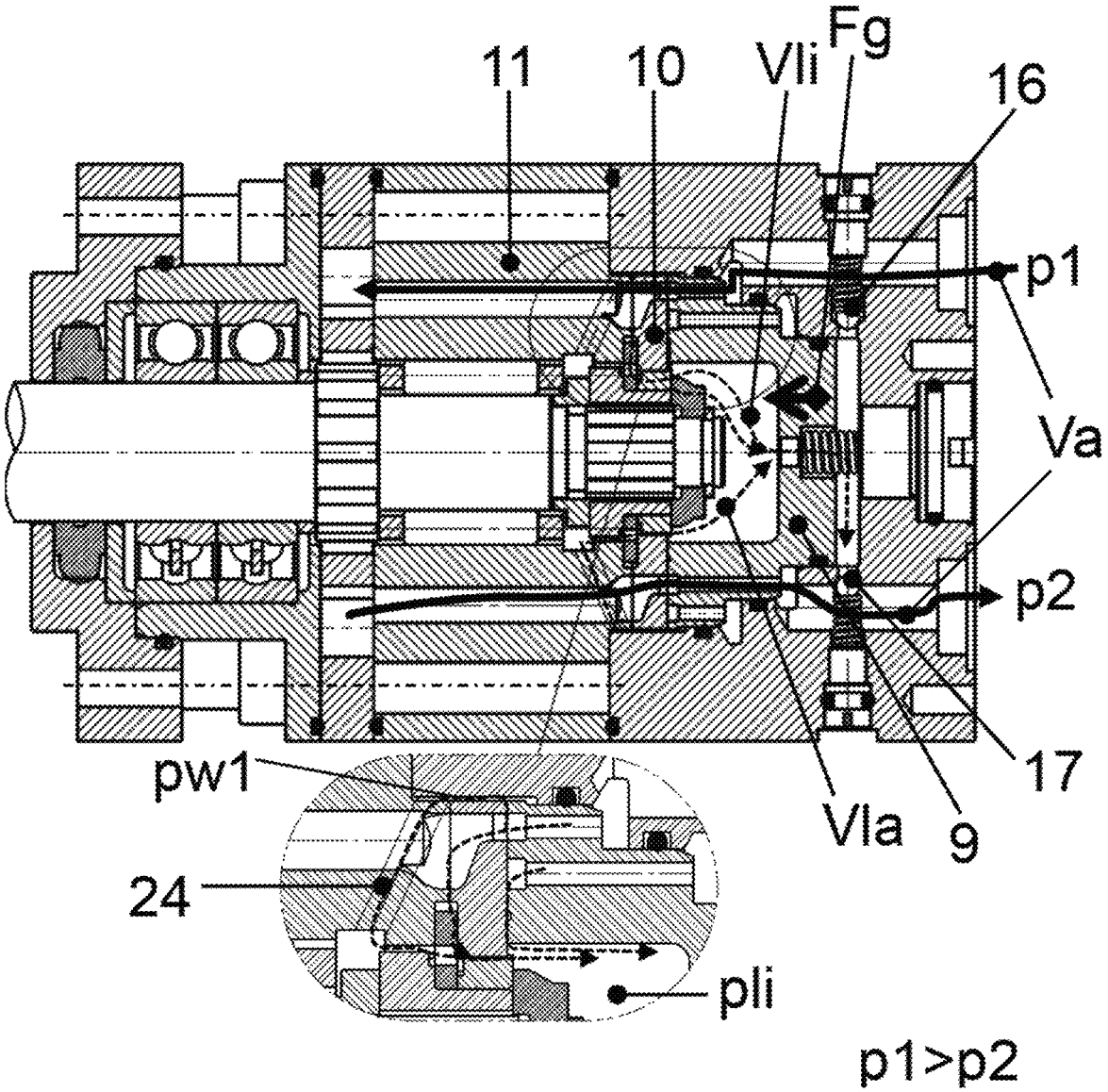
FIG. 5 shows the turbomachine in an operating state as pump or as a motor.

As is apparent from FIG. 5, the turbomachine 1 requires the total resulting force Fg in an operating state as a pump or as a motor, said force Fg pressing on the feed part 11 via the piston 9 and the distributor part 10 and therefore sealing the end faces of the piston 9, distributor part 10 and feed part 11 with respect to one another. The pressure difference between the two drive pressures p1, p2 results in the driving flow Va which drives the turbomachine 1. As a result of leaks between the piston 9, distributor part 10 and feed line 11, an inner leakage flow Vli and an outer leakage flow Vla. The two leakage flows Vla, Vli are connected to one another via preferred feed lines to the further pressure region 24. These leakage flows Vla, Vli collect and generate the inert leakage pressure pli. As soon as this inner leakage pressure pli becomes high enough, it is diverted into the lower of the two driving pressures p1, p2 via one of the two check valves 16, 17.

It is advantageous that it now becomes possible to operate the turbomachine 1 with just two feed lines at all operating points only in conjunction with the same properties during right-hand rotation and left-hand rotation. The third leakage line for diverting the leakage flows Vla, Vli is dispensed with.

A further advantage is that the distributor part 10 is supplied axially via the piston 9 and the connecting part 4 virtually without deflection and the large cross-sections of the through-openings 26, 27 for the two driving pressures p1, p2 also result in very large flow cross-sections. Both of these things contribute to a high overall efficiency η.

A further advantage is also that the turbomachine 1 is optimized in terms of manufacture and technology in all of its parts, since, apart from a feed line to the further pressure region 24, there are no oblique boreholes.

Figure 6:
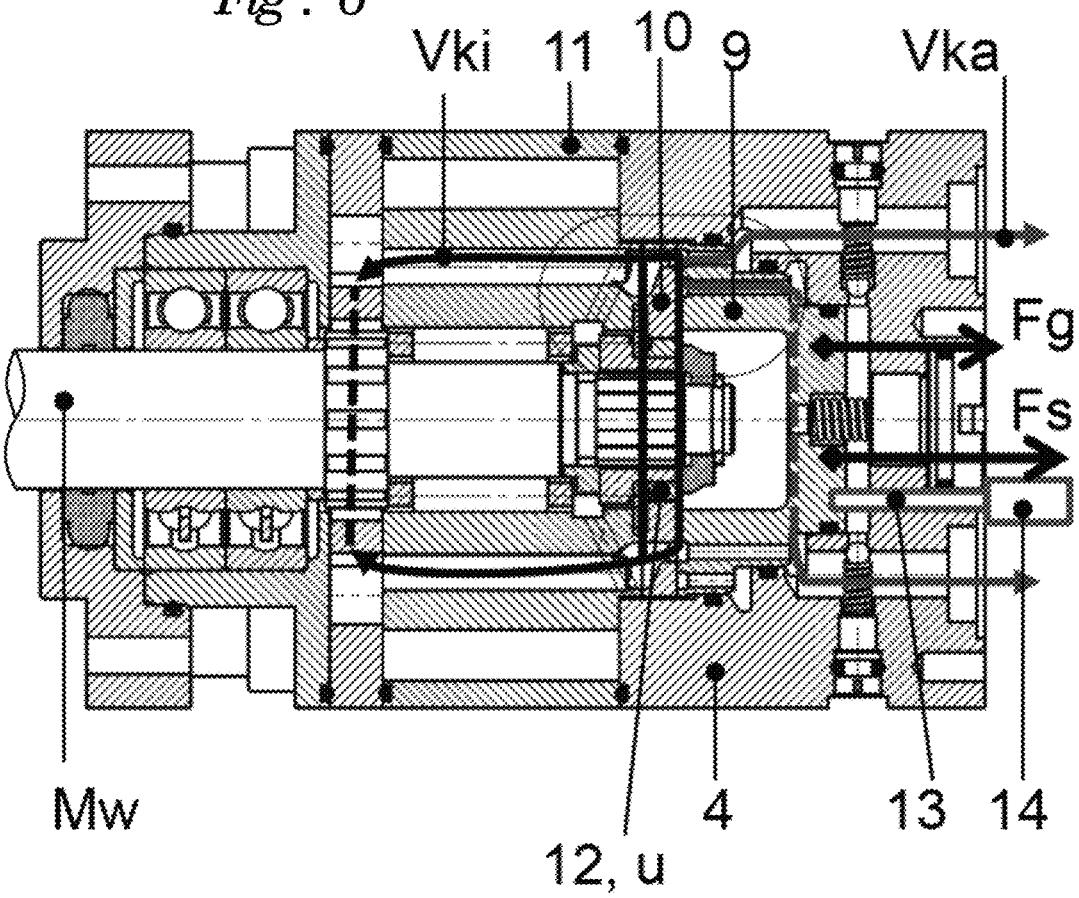
FIG. 6 shows the turbomachine in a free-wheeling operating state.

As is apparent from FIG. 6, the turbomachine 1 is placed in a free-wheeling operating state if the total resulting force Fg presses the piston 9 away from the distributor part 10. For this purpose, a force Fs is applied to the piston 9 via a control device 13 with a drive for the control device 14. As a result, gaps arise between the piston 9 of the distributor part 10 and the feed part 11, via which gaps an inner short-circuit flow Vki and an outer short-circuit flow Vka form. By means of the control device 13 it is advantageously possible to make a very sensitive transition from the free-wheeling into the starting of the machine, with a result that a soft start occurs.

Since the shaft of the controller 2 is connected via the drive 12 of the distributor part 10 to the reduction ratio and to the distributor part 10, it is advantageously possible to brake by reversing the control force Fs of the distributor part 10 between the piston 9 and the feed part 11, and in this way directly influence the torque at the shaft Mw.

A further advantage is that the braking torque which arises when the free wheel is opened is very low, as no inner braking torques can arise anymore as a result of the total resulting force Fg.

Figure 7:
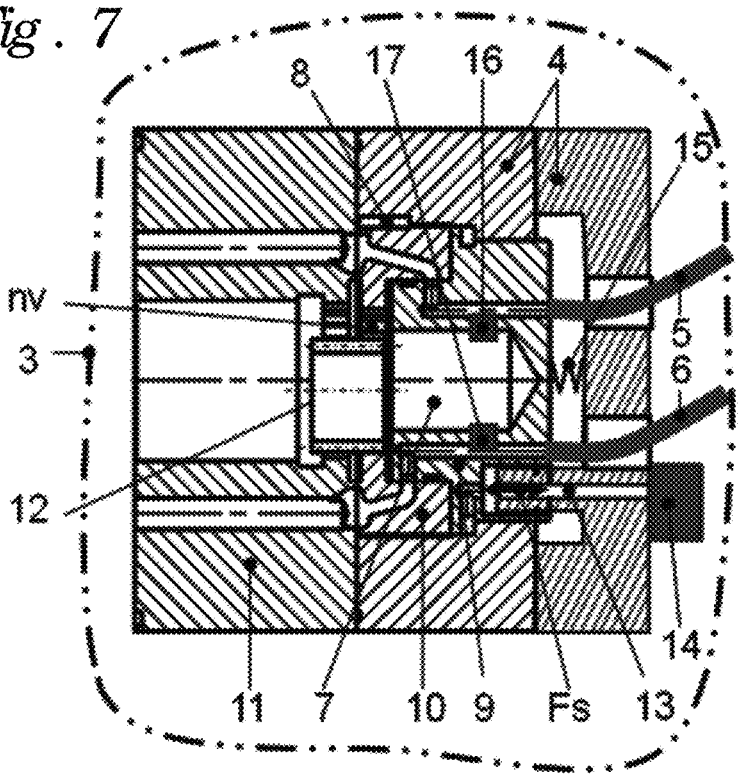
FIG. 7 shows an embodiment of the controller.

As is apparent from FIG. 7, the connections 5, 6 can also be arranged directly on the piston 9. The spring 15 presses the distributor part 10 onto the feed part 11 via the piston 9. The distributor part 10 is supplied in this preferred arrangement radially from the inside of the drive pressures p1, p2. As a result, the axial forces Fp1, Fp2 which result from the supply pressures p1, p2 become virtually zero.

It is advantageous that pressure fluctuations of the driving forces p1, p2 in this embodiment no longer influence the total resulting force Fg. In this preferred embodiment, the control device 13 is advantageously composed of a fluid which is located in a cylinder which is arranged between the piston 9 and the two connecting parts 4. The drive of the control device 14 applies the control pressure to this fluid, and thereby generates the control force Fs. The distributor part 10 is driven by the drive 12 of the distributor part 10 with the rotational speed nv. In this context, the two check valves 16, 17 are arranged between the inner leakage region 7 and the connections 5, 6.

A further advantage of this embodiment of the turbomachine 1 is also due to the fact that the total system is operated by means of fluids thereby facilitating integration into a total system in which the control information is already present in the form of a control pressure.

Figure 8:
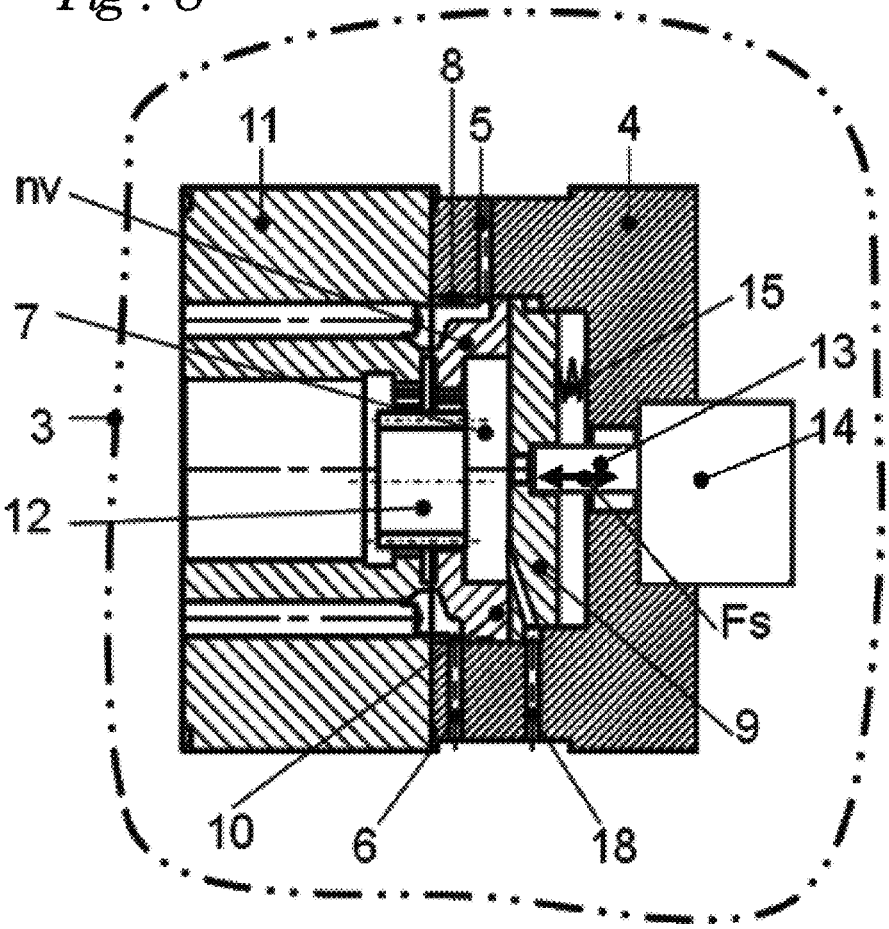
FIG. 8 shows a further embodiment of the controller.

As is apparent from FIG. 8, in a further refinement of the controller 3 the connections 5, 6 are arranged on the connecting part 4 and supply the distributor part 10 with the driving pressures p1, pw directly and not via the piston 9. Is it advantageous here that as a result the axial forces Fp1, Fp2 which result from the supply pressures p1, p2 act radially and thereby become zero in the axial direction. Pressure fluctuations of p1, p2 therefore have no influence anymore on the total resulting force Fg. The spring 15 presses the distributor part 10 onto the feed part 11 via the piston 9. In this preferred arrangement, the distributor part 10 is supplied radially from the outside with the driving pressures p1, p2. The drive of the control device 14 applies a control force Fs to the piston via the control device 13. The distributor part 10 is driven by the drive 12 of the distributor 10 with the rotational speed nv. The further pressure region is arranged on the outside of the distributor part 10. A separate leakage connection 18 is arranged in the connecting part 4. The fluid is a gaseous fluid which passes into the turbomachine 1 via the connection 5 at the driving pressure p1, and flows into the open air via the connection 6 with the result that the leakage current Vli can also flow off into the open air via the leakage connection 18, without having to firstly build up a pressure to activate check valves 15, 16. As a result, the starting pressure p1 of the turbomachine 1 drops to an advantageous minimum. A further advantage of this embodiment is that the turbomachine 1 can be constructed more advantageously without check valves.

Figure 9:
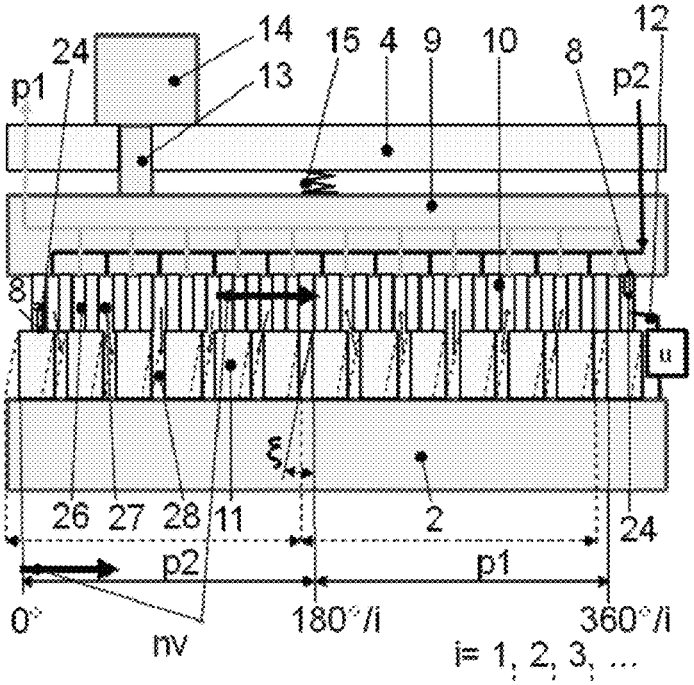
FIG. 9 shows a block circuit diagram of the turbomachine.

As is apparent from FIG. 9, a turbomachine 1, which is illustrated rolled up in the angular region 0 to 360° C./i i=1, 2, 3 . . . in a block circuit diagram, is composed of a power section 2 on which a controller 3 is arranged. The piston 9 is arranged on the distributor part 10. The spring 15 is arranged between the connecting part 4 and the piston 9. The spring 15 presses the piston 9 firstly against the distributor part 10. The control device 13, on which the drive 14 is arranged, can optionally be arranged on the piston 9. The driving pressures p1, p2 are applied to the piston 9 and to the individual through-openings 26, 27 in the distributor part 10. The distribution of these two driving pressures p1, p2 to, in each case two, pressure ranges from 0° to 180°/i and from 180°/i to 360°/i is carried out by the distributor part 10 by means of a difference between the number of through-openings 26, 27 in the distributor part 10 and the number of feed lines to the power section 28 in the feed line 11. Further pressure regions 8, which are represented here by feed lines 24, act on the end sides of the distributor part 10.

The power section 2 with the rotating inflow and outflow is arranged on the feed part 11. The drive 12 of the distributor part 10 is arranged between the distributor part 10 and the power section 2. The power section 2 drives the distributor part 10 synchronously via the drive 12, with the result that both rotate the distributor part 10 synchronously with the rotational speed nv. Between the distributor part 10 and the power section 2 there is an adjustment angle ξ with the result that the pressure regions p1, p2 of the power section 2 can lead, be precisely in synchronism with or lag with respect to the distributor part 10. Depending on the design of the power section 2, a reduction ratio u for adapting the rotational speed is necessary for this.

It is advantageous here that the drive 12 of the distributor part 10 no longer has to be necessarily coaxial with the distributor part 10. A further advantage is that depending on the type of power section 2 the reduction ratio u can also be equal to 1, and therefore direct drive is possible, which does not give rise to any additional running noise. It is advantageous that the efficiency η and also the symmetry of the characteristic curves K0, K1, K2, K3 can be changed by means of the leading or lagging of the distributor part 10 with respect to the power section 2 by the adjustment angle ξ.

Figure 10:
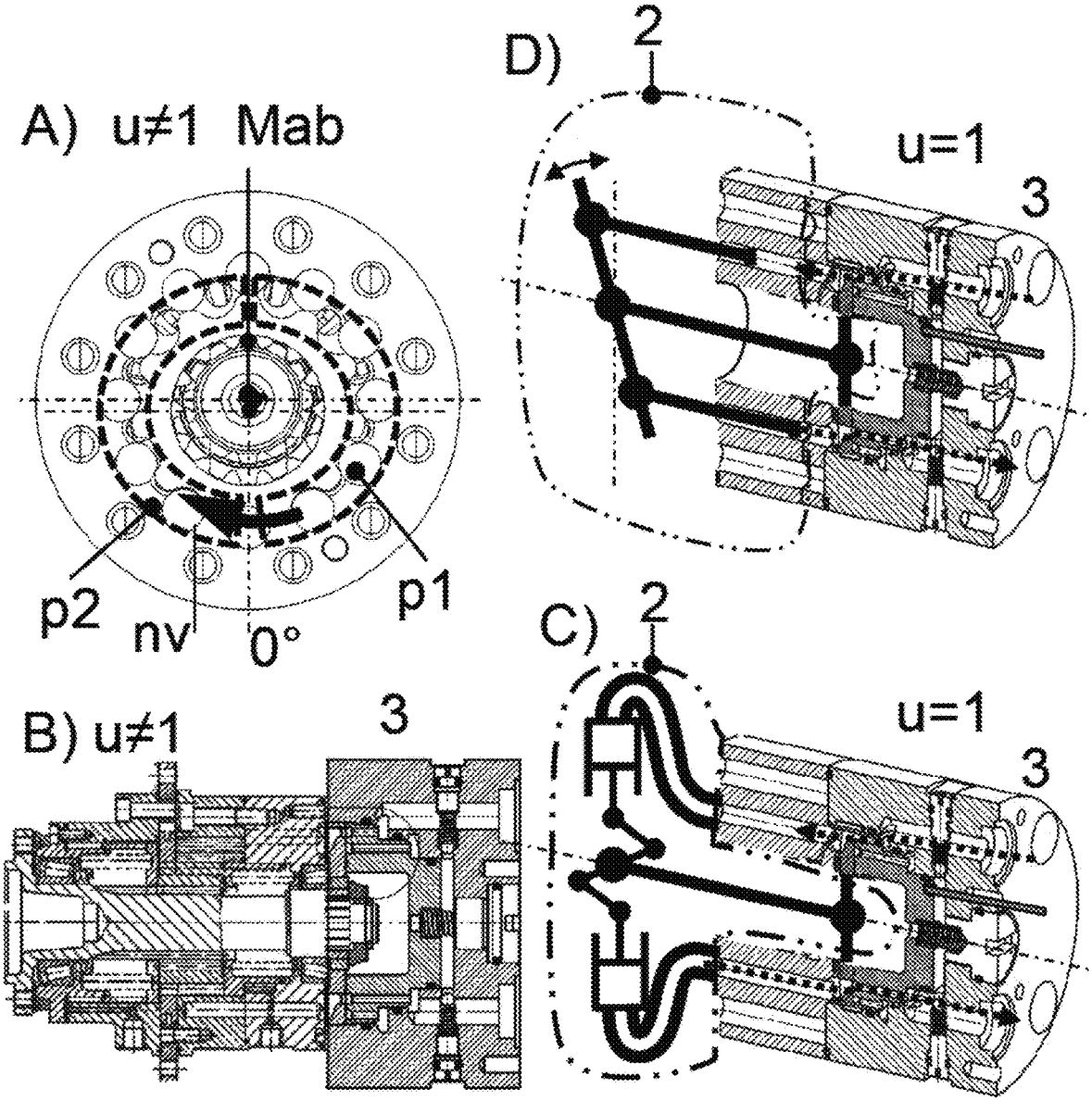
FIG. 10 shows, by way of example, four embodiments of a power section with rotating inflow and outflow.

As is apparent from FIG. 10, a plurality of designs of power sections 2 with a rotating inflow and outflow are conceivable, which designs can be combined with the controller 3 to form a turbomachine 1.

In the first embodiment A, the power section 2 is composed of a GEROTOR machine with a constant volume flow, as can be seen in section in FIG. 1. A section through the GEROTOR machine is illustrated, said section showing the two pressure regions with the driving pressures p1, p2. The reduction ratio u is not equal to 1. The two pressure regions with the driving pressures p1, p2 rotate at the rotational speed nv. The advantage here is the simple and compact design of such a turbomachine 1.

In the second embodiment B, the power section 2 is composed of a GEROTOR machine with an adjustable volume flow. Said machine is illustrated in section. The most important advantage is the adjustability of the volume flow, which is absolutely necessary in many applications.

In the third embodiment C, the power section 2 is composed of an axial piston machine with a wobble plate. The shaft of this machine is connected directly to the distributor part 10 of the controller 3. The reduction ratio u is therefore equal to 1. This results in a particularly simple design, which can also be adjustable by means of the inclination of the wobble plate in the volume flow, and with u=1 permits a particularly simple and quiet direct drive of the controller 3.

In the fourth embodiment D, the power section 2 is composed of a radial piston machine with connecting rods and a crankshaft. The shaft of this machine is connected directly to the distributor part 10 of the controller 3. The reduction ratio u is therefore equal to 1.

A quite central advantage of the turbomachine 1 according to the invention is to combine it with a multiplicity of conceivable power sections 2 in order to provide an ideal solution for the respective application of the turbomachine 1.

LIST OF REFERENCE SYMBOLS

1 Turbomachine
2 Power section with rotating inflow and outflow
3 Controller
4 Connecting part
5 First connection
6 Second connection
7 Leakage region, inner
8 Further pressure region
9 Piston
10 Distributor part
11 Feed part
12 Drive of distributor part
13 Control device
14 Drive of control device
15 Spring
16 First check valve
17 Second check valve
18 Leakage connection
19 Adjustment range
20 Blocking
21 Braking
22 Adaptation
23 Free-wheel
24 Feed line
25 Limiting point
26 Through-opening of drive pressure p1
27 Through-opening of drive pressure p2
28 Feed lines to power section
72 Efficiency
Mw Torque of shaft
Nw Rotational speed of shaft
Nv Rotational speed of distributor part
Fp1 Force from drive pressure p1
Fp2 Force from drive pressure p2
Fs Control force
Ff Spring force
Fl Force of leakage pressure
Fw Force of further pressure
FgsA Total force at end side acc. to prior art FgsB Total force at end side acc. to embodiment B
FgsC Total force at end side acc. to embodiment C
Fgx Total resulting force
p1 First driving pressure
p2 Second driving pressure
ξ Adjustment angle
Va Driving flow
Vki inner short-circuit flow
Vka outer short-circuit flow
pli Leakage pressure, inner
ps Control pressure
Vli Leakage flow, inner
Vla Leakage flow, outer
pw1, pw2 . . . Further pressure
Vw Further flow
A Areas
A1,A2,A3 Equivalent areas acc. to prior art B1, B2, B3, B4 Equivalent areas acc. to embodiment B C1, C2, C3, C4, C5, . . . Equivalent areas acc. to embodiment C K0, K1, K2, K3 Characteristic curves
u reduction rod ratio

The invention claimed is:

1. A hydraulic machine capable of operating as a hydraulic motor and as a pump, comprising:

an axially and radially fixed rotating shaft having an external toothing, the shaft extending along a shaft axis;

a stator having an internal toothing;

an eccentric rotor having an internal toothing which meshes with the external toothing of the rotating shaft and an external toothing which meshes with the internal toothing of the stator;

a distributor arranged between a feed part and a piston, the distributor having a number of through-openings which are circumferentially alternatingly in fluid communication with an inlet and an outlet for supplying and discharging fluid through a different number of feed lines within the feed part from a space between the eccentric rotor and the stator as the eccentric rotor orbits around the rotating shaft; and a control device operatively connected to the piston and configured to apply an adjustable axial force to the piston, wherein the control device is operable of braking the machine by pushing the piston against the distributor.

2. The hydraulic machine as in claim 1, wherein the control device is operable of placing the machine in a free-wheeling operating state by pulling the piston away from the distributor.

3. The hydraulic machine as in claim 1, wherein the control device comprises a hydraulic fluid which acts on a face of the piston.

4. The hydraulic machine as claimed in claim 1, further comprising a drive for the control device, wherein the piston or the distributor or the control device is magnetic and wherein the drive for the control device is an electromagnet.

5. The hydraulic machine as claimed in claim 1, further comprising a spring which pushes the piston and the distributor against the feed part.

6. The hydraulic machine as claimed in claim 1, wherein the shaft is radially secured in the machine by a bearing.

7. The hydraulic machine as in claim 1, wherein the distributor is connected to the shaft by a drive and rotates synchronously with the orbiting motion of the eccentric rotor.

8. The hydraulic machine as in claim 1, wherein a number of teeth in the internal toothing of the rotor and a number of teeth in the external toothing are different and wherein a number of teeth in the external toothing of the rotor and a number of teeth in the internal toothing of the stator are different.

* * * * *